US009434124B2

(12) United States Patent
Belko et al.

(10) Patent No.: US 9,434,124 B2
(45) Date of Patent: Sep. 6, 2016

(54) COMBINATION CONTAINER AND BAG

(75) Inventors: Stephen P. Belko, Blackwood, NJ (US); Neil J. Kozarsky, Mount Laurel, NJ (US); Eliot M. Kozarsky, Moorestown, NJ (US); John A. Caporaso, Moorestown, NJ (US)

(73) Assignee: ZIPBOX LICENSE, LLC., Marlton, NJ (US)

( * ) Notice: Subject to any disclaimer, the term of this patent is extended or adjusted under 35 U.S.C. 154(b) by 1178 days.

(21) Appl. No.: 12/655,752

(22) Filed: Jan. 5, 2010

(65) Prior Publication Data

US 2011/0017812 A1 Jan. 27, 2011

Related U.S. Application Data

(63) Continuation-in-part of application No. 12/460,682, filed on Jul. 23, 2009.

(51) Int. Cl.

| | |
|---|---|
| ***B31B 1/60*** | (2006.01) |
| ***B31B 7/00*** | (2006.01) |
| ***B65D 5/12*** | (2006.01) |
| ***B65D 5/44*** | (2006.01) |

(Continued)

(52) U.S. Cl.

CPC . *B31B 7/00* (2013.01); *B65D 5/12* (2013.01); *B65D 5/443* (2013.01); *B65D 31/06* (2013.01); *B65D 33/2508* (2013.01); *B31B 2201/295* (2013.01); *B31B 2201/6026* (2013.01); *B31B 2201/9071* (2013.01); *B31B 2217/0007* (2013.01); *B31B 2217/0076* (2013.01)

(58) Field of Classification Search

CPC ..... B31B 7/00; B31B 2217/0076; B31B 2201/295; B31B 2201/9071; B65D 5/12; B65D 5/443; B65D 31/06

USPC ..... 493/84, 87, 93, 102, 114, 121, 131, 493/133, 150, 213

See application file for complete search history.

(56) References Cited

U.S. PATENT DOCUMENTS

| | | | |
|---|---|---|---|
| 3,902,652 | A | 9/1975 | Malcolm |
| 4,226,170 | A | 10/1980 | Christensson |
| 4,779,998 | A | 10/1988 | Wischusen, III |

(Continued)

FOREIGN PATENT DOCUMENTS

| | | |
|---|---|---|
| CN | 1398764 | 2/2003 |
| CN | 101087719 | 12/2007 |

(Continued)

OTHER PUBLICATIONS

PCT/US2010/042282, International Search Report and Written Opinion of the International Searching Authority, Feb. 28, 2011.

(Continued)

*Primary Examiner* — Sameh Tawfik
(74) *Attorney, Agent, or Firm* — Cozen O'Connor

(57) ABSTRACT

Bag-on-container assemblies and bag-in-container assemblies are disclosed. The container may include a paperboard box having a front wall, a rear wall, a pair of opposed side walls, a plurality of flaps capable of forming a bottom wall and a plurality of flaps capable of forming a top wall. The inside surfaces of the box walls, including the outwardly facing strips, may have a thermal plastic coating thereon. The bag component of each type of assembly may include a closure member for to enable resealing of the bag component.

9 Claims, 12 Drawing Sheets

(51) Int. Cl.

| | |
|---|---|
| ***B65D 30/16*** | (2006.01) |
| ***B65D 33/25*** | (2006.01) |

(56) References Cited

U.S. PATENT DOCUMENTS

| | | | |
|---|---|---|---|
| 4,815,631 | A | 3/1989 | Eeg et al. |
| 5,249,685 | A | 10/1993 | Stephens |
| 5,461,845 | A | 10/1995 | Yeager |
| 5,553,708 | A | 9/1996 | Lawrence et al. |
| 5,755,962 | A | 5/1998 | Gershenson et al. |
| 5,788,378 | A | 8/1998 | Thomas |
| 6,082,897 | A | 7/2000 | Galomb |
| 6,585,153 | B2 | 7/2003 | Ryan |
| 6,908,422 | B2 | 6/2005 | Ichikawa et al. |
| 6,986,729 | B2 | 1/2006 | Ichikawa et al. |
| 7,066,869 | B2 | 6/2006 | Cook et al. |
| 7,160,029 | B2 | 1/2007 | Bein et al. |
| 7,350,670 | B2 | 4/2008 | Steeves et al. |
| 7,624,873 | B2 | 12/2009 | Tennant et al. |
| 8,220,651 | B2 | 7/2012 | Norcom |
| 2003/0183650 | A1 | 10/2003 | Muise et al. |
| 2005/0194386 | A1 | 9/2005 | Shai |
| 2006/0137997 | A1 | 6/2006 | Bein et al. |
| 2006/0193541 | A1 | 8/2006 | Norcom |

FOREIGN PATENT DOCUMENTS

| | | |
|---|---|---|
| CN | 101119899 | 2/2008 |
| EP | 1775229 | 4/2007 |
| FR | 1 182 724 | 6/1959 |
| JP | 42-10718 | 6/1942 |
| JP | 42-10718 | 6/1967 |
| JP | 02-016748 | 1/1990 |
| JP | 2003-034338 | 2/2003 |
| JP | 2003-341651 | 12/2003 |
| JP | 2005-104483 | 4/2005 |
| JP | 2007-069944 | 3/2007 |
| JP | 2007-076698 | 3/2007 |
| JP | 2008-529908 | 8/2008 |
| JP | 2009035317 | 2/2009 |
| WO | WO 98/13271 | 4/1998 |

OTHER PUBLICATIONS

Office Action dated Mar. 9, 2016 which issued in the corresponding Japanese Patent Application No. 2012-521695.

COMBINATION CONTAINER AND BAG

This application is a continuation in part of pending U.S. patent application Ser. No. 12/460,682 filed Jul. 23, 2009.

FIELD OF THE INVENTION

The present invention relates to packaging and containers. More particularly, the present invention relates to a combined container and bag and to its method of manufacture.

BACKGROUND OF THE INVENTION

Flowable materials including foodstuffs such as cereals and the like and numerous other products have been sold in packaging such as boxes for many years. Such packaging is desirable since the packages protect the product from spoilage and physical damage. These packages also stack easily for shipping and for display on shelves. Packages such as boxes employ an inner bag that contains the product within the box. After the bag is opened and the desired amount of product removed, the bag is resealed, usually by folding the top of the bag over upon itself.

Such inner bags, however, are frequently difficult to open and almost never reseal effectively.

Recently, products have been proposed wherein the bag is outside of the box rather than inside the box. U.S. Pat. No. 6,908,422, shows a paperboard box inserted into a plastic bag that has a closeable zippered top. The box is inserted while in its collapsed form and is manipulated into an open position when it is desired to fill the box. This can create problems during use since the entire box is in the bag and can damage the bag when attempting to open the box.

Published U.S. Patent Application No. U.S. 2005/0194386 is directed to a zippered, plastic bag box cover for resealing paperboard boxes. The zippered plastic bag is positioned at the top of the box. The bag has an open bottom and elastic strip around the bottom edge of the bag to secure the bag to the box. This arrangement does not appear to provide an effective seal.

A similar arrangement is shown in U.S. Pat. No. 7,160,029. In the embodiment shown in FIG. 9b thereof, the lower edge of the bag includes a strip of adhesive at the bottom of the bag. While this may create a better seal in some instances, this seal does nothing to enable closure of the inner bag, nor to improve closure on the other end of the carton, thereby leaving the product inside the carton to be relatively unprotected from spoilage due to moisture and oxygen infiltration.

There is, therefore, a need for a combined container and bag that is capable of effectively sealing to the container. There is also a further need for a combined container and bag wherein the bag may be resealed after the bag has been opened.

SUMMARY OF THE INVENTION

In a first embodiment, there is provided a container that includes a container member and bag member, preferably a resealable bag member, where the bag member is disposed over the container member to produce a bag-on-container type assembly.

In a second embodiment, the bag member may be disposed within the container member to produce a bag-in-container type assembly.

In both bag-on-container and bag-in-container type assemblies, the container member may have any desired configuration such as tubular containers and box type containers. Preferably, the container member is in the form of a box that includes a front wall, a rear wall, a pair of opposed sidewalls and a plurality of flaps. The box may be formed from a box blank that includes a plurality of flaps that may be manipulated to form a bottom wall of the box container. The front, rear and sidewalls, as well as flaps, may be manipulated to form a box type container.

Where the container member is in the form of a box, in one aspect, the upper end of each of the front wall, rear wall and side walls of the box may be folded outwardly and downwardly to enable interior surfaces of the upper ends of the box walls to form outwardly facing strips on the box blank. These facing strips may bear one or more coatings thereon such as thermoplastic coatings, adhesive coatings or combinations thereof to aid in securing of a bag member to the strips of the box blank to yield a bag-on-container type container.

Advantageously, a container that includes the container member and bag member in either bag-on-container type assembly or as a bag-in-container type assembly may enable achievement of product packing volumes greater than conventional packaging of equal size. This may enable use of fewer pallets, fewer trucks and less energy consumption in product shipment.

Advantageously, a container that includes the container member and bag member in either bag-on-container type assembly or as a bag-in-container type assembly may enable achievement of moisture ingress protection to as low as about 1 gram pr year to about 2 gms per year.

Other features and advantages of the invention will be readily apparent from the following detailed description of a preferred embodiment thereof taken in conjunction with the drawings.

BRIEF DESCRIPTION OF THE DRAWINGS

For the purpose of illustrating various aspects of the invention, there is shown in the drawings forms that are preferred. It is understood, however, that this invention is not limited to the precise arrangements shown in the drawings.

SUMMARY OF THE INVENTION

Figure 1:
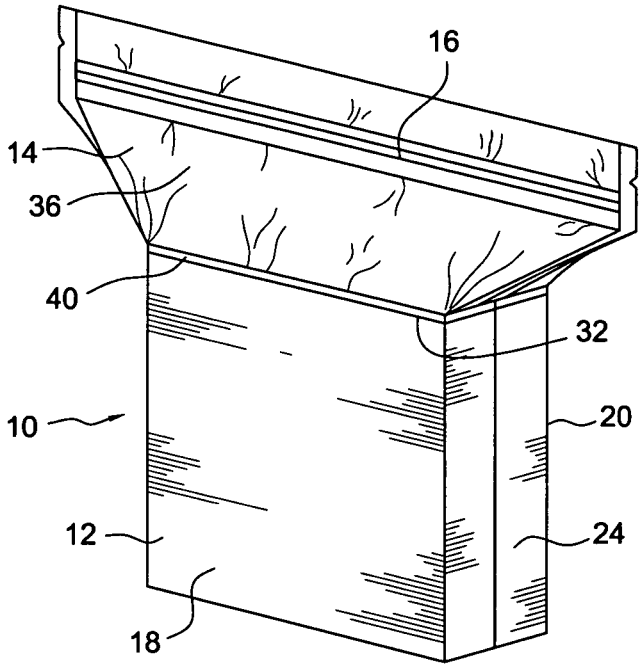
FIG. 1 is a front perspective view of an embodiment of a container that includes a container member and a bag member in an assembled configuration where the bag member is disposed over a container member to produce a bag-on-container type assembly.
Figure 2:
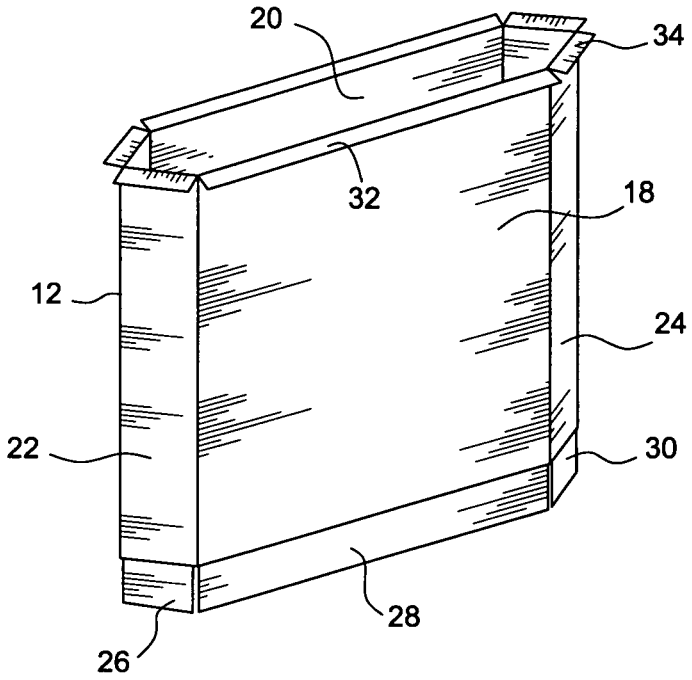
FIG. 2 is a perspective view of a box blank for use in manufacture of a box type container member that shows outwardly extending strips at the top of the box blank.

In one aspect, a bag-on-container assembly is disclosed. The bag-on-container assembly includes a container member and a resealable bag member having an open end and a closed end, the container member having an access portion configured to provide an opening in the container member to access the interior of the container member wherein the open end of the bag member is secured to the exterior of container member over the access portion of the container member, and wherein the bag member is secured to the container member by a joining means suitable for achieving an airtight seal between the container member and the bag member. The closed end of the bag member may include a closure means to enable resealing of the closed end of the bag member. The closure means may be a linear fastener of a predetermined length such as a zipper.

The bag member of the bag-on-container assembly may have lower edge portions that bear adhesive to enable the bag member to be secured to container member such as by heat sealing to achieve an air tight seal.

The container member of the bag-on-container assembly may be in the form of a box that has front, rear and side walls wherein the upper ends of each of said front, rear and side walls are adapted to fold outwardly and downwardly whereby at least one interior surface of each of the upper ends provides one or more strips that has a thermal plastic coating thereon to enable the bag member to be heat sealed to one or more of the strips.

In another aspect, the invention relates to a bag-in-container assembly that includes a container member and a resealable, bag member having an open end and a closed end. The container member has an access portion configured to provide an opening in the container member to access the interior of the container member wherein the open end of the bag member is secured to at least one interior surface of the container member within the access portion of the container member. The closed end of the bag member may include a closure means such as a zipper to enable resealing of the closed end of the bag member. The zipper may be located at a corner of the closed end of the bag member. The bag member has lower edge portions that may bear adhesive to enable the bag member to be secured to an interior surface of the container member such as by heat sealing. The lower edge portions of the bag member may be secured to the interior of the container member above the bottom surface of the container member.

In a further aspect, the invention relates to a method of forming a bag-on-container assembly by providing a box blank suitable for forming a container member having a front wall, a rear wall, a pair of opposed side walls and a plurality of flaps capable of forming a bottom wall and wherein said front, rear and side walls have upper ends and lower ends and inside surfaces and outside surfaces. A bag member having an open end and a closed end, wherein the bag member has downwardly extending front and rear walls, is sealed to an exterior portion of the box blank while the blank is in a flat planar condition, and thereafter, the box blank is expanded to form a bag-on-container assembly. The bag member may include a resealable closure means such as a zipper to enable resealing of the closed end of the bag member. The zipper may be located at a corner of the bag member.

In yet another aspect, the invention relates to a method of forming a bag-in-container assembly. The method entails providing a mandrel suitable for supporting a bag member and a container member thereon, placing the bag member on the mandrel and placing the container member over the bag member on the mandrel, and applying pressure to the container member to join the bag member to the container member to yield a bag-in-container assembly.

Having summarized the invention, the invention is further described below by reference to the following detailed description.

DETAILED DESCRIPTION OF THE INVENTION

As used herein, the term "bag member" is understood to mean a receptacle formed from a material that may be sealed at one end whereby the receptacle has a closed end and an open end.

As used herein, the term airtight seal is understood to mean <0.1 liters/year of gas exchange between the seal between the bag and container and the atmosphere.

In the embodiments and variations in the bag-on-container and the bag-in-container assemblies of the invention a wide variety of materials may be employed. Materials that may be employed in manufacture of container member 12 employed in the bag-on-container and bag-in-container type assemblies include but are not limited to celluloses, metals, plastics and combinations thereof such as laminates of one or more of celluloses, metals and plastics. Laminates may include two or more layers. The materials employed in container member 12 may be metalized, coated with glass, or otherwise treated to enhance barrier properties.

Metals that may be employed to form container member 12 include but are not limited to aluminum, iron alloys such as steel, tin, and combinations thereof. Celluloses that may be employed to form container member 12 include but are not limited to celluloses such as cardboard, paperboard, cellophanes and combinations thereof. The celluloses may bear one or more coatings of materials such as one or more thermoplastics.

Thermoplastics that may be employed as coatings include but are not limited to olefins such as polyethylene, polybutylene and polypropylene, and copolymers thereof, ionomers such as ethylene copolymers that include acid groups partially neutralized with metal salts such as zinc, sodium, magnesium and lithium and combinations thereof. These ionomers are available from DuPont under the trade name Surlyn. The thickness of coatings such as thermoplastic coatings on cellulose materials such as paperboard and cardboard may vary from about 0.0001 inch to about 0.004 inches, preferably about 0.0003 inches to about 0.003 inches, more preferably about 0.0005 inches to about 0.002 inches.

Plastics that may be employed to form container member 12 include but are not limited to thermoplastics as well as thermosetting plastics. Thermoplastics that may be employed to form container member 12 include but are not limited to olefins such as polyethylene, polybutylene and polypropylene as well as copolymers thereof. Other polymers that may be employed include but are not limited to polyamides such as nylons, polyesters, polyvinylcarbonates, and cellophane and combinations thereof. Thermoplastics that may be employed include but are not limited to woven polyethylene such as Tyvek from DuPont.

Thermosetting plastics that may be employed to form container member 12 include but are not limited to polyimides, epoxies and mixtures thereof.

Adhesives that may be employed in bag-on-container type assemblies as well as in bag-in-container type assemblies include but are not limited to natural adhesives, synthetic adhesives, pressure sensitive adhesives or mixtures thereof. Adhesives employed typically may be bonded at temperatures of about 0° F. to about 300° F., preferably about 50° F. to about 200° F., more preferably about 72° F. to about 125° F.

The materials employed in bag member 14 for use in bag-on-container and bag-in-container type assemblies may be porous, non-porous or semi-permeable and may be made from a variety of materials. These materials include but are not limited to metals, celluloses, thermoplastics and combinations thereof such as laminates thereof.

Metals that may be employed to form bag member 14 include but are not limited to aluminum, tin, copper, silver, gold and combinations thereof such as laminates thereof. Metals may be employed in the form of foils that have a thickness of about 0.000001 inch to about 0.003 inch, preferably about 0.0003 inch to about 0.002 inch, more preferably about 0.00035 inch to about 0.0007 inch.

Thermoplastics that may be employed to form bag member 14 include but are not limited to olefins such as polyethylene, polypropylene, polybutylene and copolymers thereof. Other polymers that may be employed to form bag member 14 include but are not limited to polyamides such as nylon, polyesters such as polyethylene terephthalate, polyvinylchloride. Typically, the thickness of thermoplastic materials employed to form bag member 14 is about 0.0005 inches to about 0.0070 inches, preferably about 0.001 inch to about 0.006 inch, more preferably about 0.0015 inch to about 0.005 inch.

Laminates that may be employed to form bag member 14 include laminates of metal and thermoplastic where the thermoplastic is in the form of a continuous coating on the metal or discontinuous coating on the metal. Permeable materials such as micro-perforated thermoplastics, micro-perforated metal, semi-permeable membranes and combinations thereof also may be used in bag member 14.

Where micro-perforated thermoplastic materials are employed, the thickness of the thermoplastic material employed to form bag member 14 is sufficient to enable bag member 14 to be manipulated into a desired configuration.

Referring to FIGS. 1-9 where like reference numerals designate like elements, there are shown bag-on-container and bag-in-container type assemblies. Container member 12 employed in bag-on-container assemblies, as well as in a bag-in-container type assemblies such as that described hereinafter, may have any desired cross-sectional configuration. Cross-sectional configurations of container member 12 may include but are not limited to rectangular, square, hexagonal, circular, oval and combinations thereof.

Container member 12 may be scored, as well as alternatively perforated in various locations to facilitate opening of container member 12 to expose bag member 14 as well as alternatively to gain direct access to contents within container member 12 such as where bag member 14 is disposed over container member 12.

In an illustrative but non-limiting example, container member 12 is scored or perforated vertically along the length of one or more portions of container member 12. One or more horizontal scores or perforations also may be placed on container member 12. The vertical and horizontal scores or perforations, alone or in combination, may facilitate access to the contents of container member 12. The horizontal and vertical scores or perforations may intersect. In this illustrative example, scores or perforations are placed vertically and horizontally. It is understood, however, that scores or perforations may be placed at any desired location on container member 12.

In both bag-on-container and bag-in-container type container assemblies, bag member 14 may be secured to container member 12 by a joining means such as adhesive, magnetic media, hook and claw fasteners such as Velcro. Adhesive bonding with or without application of heat. In a bag-on-container type assembly, adhesive may be present on interior surfaces of bag member 14 and bonded to the exterior of container member 12 in both a box blank, flattened condition as well as where container member 12 is in an expanded condition. Adhesive also may be present on selected portions of container member 12 or on the entire surface of container member 12.

Container member 12 employed in each of the bag-on-container and bag-in-container type assemblies may be in any desired configuration. Where a box blank such as box blank 52 is employed to produce container member 12, the edges of box blank 52 may be treated by skiving and hemming, or by hemming or flame treating to minimize presence of exposed, sharp edges and to improve resistance to fats/oils and liquids.

Container member 12 employed in each of the bag-on-container and bag-in-container type assemblies may be formed from materials that have a wide range of thicknesses. Typically, the thickness of the materials employed is about 0.003 inches or greater.

Where metals are employed to form container member 12, the thickness of the metal may be about 0.00025 inch to about 0.007 inch, preferably about 0.0003 inch to about 0.004 inch, more preferably about 0.00035 inch to about 0.001 inch;

Where celluloses such as paperboard are employed to form container member 12, the thickness of the paperboard may be about 0.008 inch to about 0.024 inch, preferably about 0.010 inch to about 0.018 inch, more preferably about 0.012 inch to about 0.016 inch;

Where plastics such as any one or more of thermoplastics and thermosetting plastics are employed to form container member 12, the thickness of the plastic may be about 0.0001 inch to about 0.004 inch, preferably about 0.0075 inch to about 0.002 inch.

Corrugated structures as well as single wall, double wall and triple wall constructions also may be employed to form container member 12. Corrugated structures that may be employed include but are not limited to structures such as micro-flute and e-flute structures as well as other grades of corrugated materials such as grades A, B C or D and the like. Corrugated structures may be metal fluted such as steel with paperboard and such as aluminum foil with paperboard.

Container member 12 preferably is in the form of a box that includes front wall 18, rear wall 20, opposed side walls 22 and 24 and a plurality of flaps 26, 28 and 30. Flaps 26, 28 and 30 may be folded inwardly to form the bottom wall of container member 12. The upper end of each of front wall 18, rear wall 20 and side walls 22, 24 may be folded outwardly and downwardly to form attachment strips such as strips 32 and 34. Strips 32 and 34 may be may vary in width. Typically, the width of strips 32 and 34 is about 0.01% to about 50%, preferably about 0.05% to about 20% more preferably about 5% to about 10% of the width of one of the front, rear or side walls of container member 12. Strips 32 and 34 may be folded back onto the outer surfaces of its respective wall and may be affixed to those outer surfaces by means such as glue.

In another aspect, container member 12 may be in the form of a box that has a hermetically sealed bottom. Hermetically sealed bottom sections may be made according to procedures described in U.S. Pat. No. 4185765, the teachings of which are incorporated by reference herein in their entirety. The hermetic seal may be formed by conduction heat sealing, induction sealing, ultrasonic sealing, drag sealing or combinations thereof.

Figure 10:
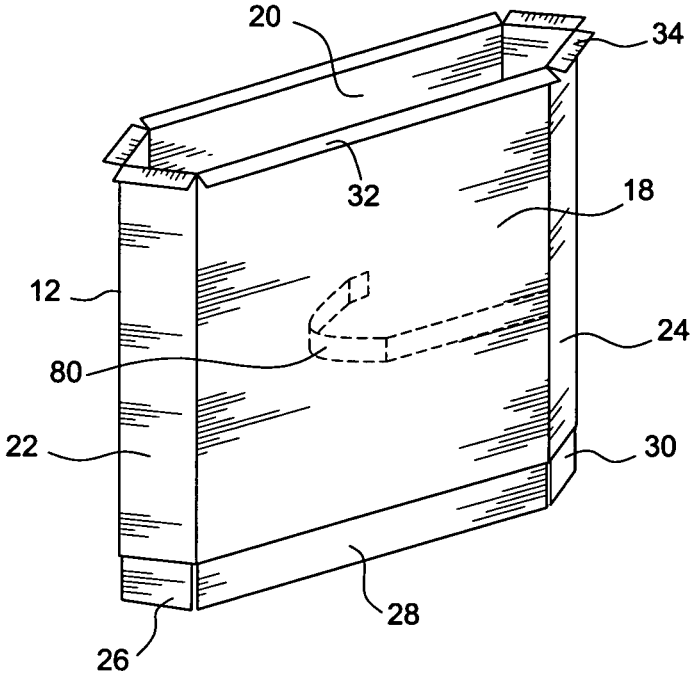
FIG. 10 shows an alternative embodiment of a container member that includes an internal reinforcement member.

In another embodiment of container member 12, as shown in FIG. 10, container member 12 may include reinforcing member 80. In this embodiment, reinforcing member 80 may be located, for example, to join opposing surfaces 18 and 20 of container member 12. Reinforcing member 80 may be formed of the same or different materials as container member 12

Bag member 14 that may be employed in any of the bag-on-container and bag-in-container type assemblies includes front wall 36 and rear wall 38. The top portions of walls 36 and 38 are joined and the lower portions are open to form an open bottomed bag member 14. In this configuration, bag member 14 is adapted to envelop a desired portion of container member 12 to produce a bag-on-container assembly. Also, in this configuration, bag member 14 may be adapted to be secured to the interior of container member 12.

Front wall 36 of bag member 14 may include lower edge portions 40 for attachment to container member 12 in both bag-on-container and bag-in-container type assemblies. Similarly, rear wall 38 of bag member 14 may include lower edge portion 42 for attachment to container member 12 in both bag-on-container and bag-in-container type assemblies.

FIG. 1 shows a bag-on-container type assembly 10 that includes a container member 12 in combination with bag member 14 where bag member 14 is disposed over the exterior of container member 12. Bag member 14 may be disposed over a portion of the exterior of container member 12 or the entire exterior of container member 12. Bag member 14 may be resealable or non-resealable, preferably resealable. Bag member 14 may be porous or non-porous, preferably non-porous.

Where bag member 14 is resealable, bag member 14 may be opened and resealed for multiple dispensing of product from container member 12. Where bag member 14 is resealable, bag member 14 may be resealed by means of resealable closure 16. Where zippers are employed as a resealable closure 16, the zippers may be any one or more of press-to-close zippers and slidable type zippers. Closures such as zippers may be positioned to enable opening of bag member 14 across the entire length, width or height of bag member 14. Resealable closures also may be positioned at any other location on bag member 14 such as at one or more corners of bag member 14.

Figure 9A:
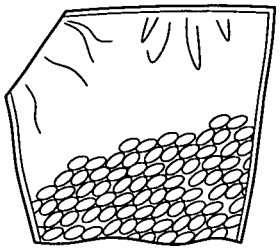
FIGS. 9A-9C show a bag member where the closure member is located at the corner of the bag member.
Figure 9B:
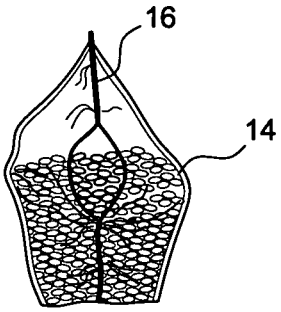
Figure 9C:
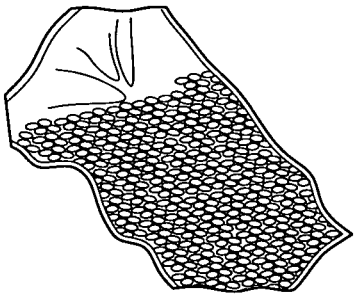

Bag member 14, where employed in manufacture of a bag-on-container type assembly, may be non-sealable or resealable, preferably resealable. Where bag member 14 is resealable, bag member 14 may employ a resealable closure 16 at a desired location of bag member 14, such as the top of bag member 14 as well as at one or more corners of bag member 14 as shown in FIG. 9.

A resealable closure such as a zipper may be located at, such as, any one or more of the left side or the right sides of container member 12. The resealable closures may be positioned to enable bag member 14 to open to form a spout type orifice for dispensing product from container member 12.

Bag member 14 may be secured to container member 12 by various methods such as heat sealing and adhesive bonding. Where bag member 14 is joined to a container member 12 formed from a box blank such as box blank 52, lower edge portions 40 and 42 of bag member 14 may be sealed to strips 32 and 34 on container member 12 while container member 12 is in its box blank form such as in its flattened state as shown in FIG. 3.

Figure 3:
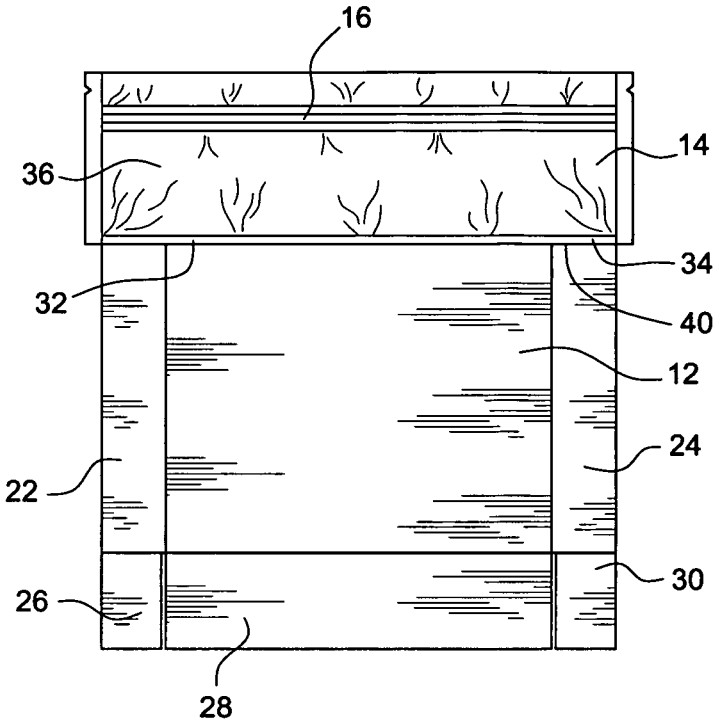
FIG. 3 is a front elevational view of a bag attached to the top of a box blank where the box blank is in a flat planar state for use in manufacture of a bag-on-container type assembly.
Figure 4:
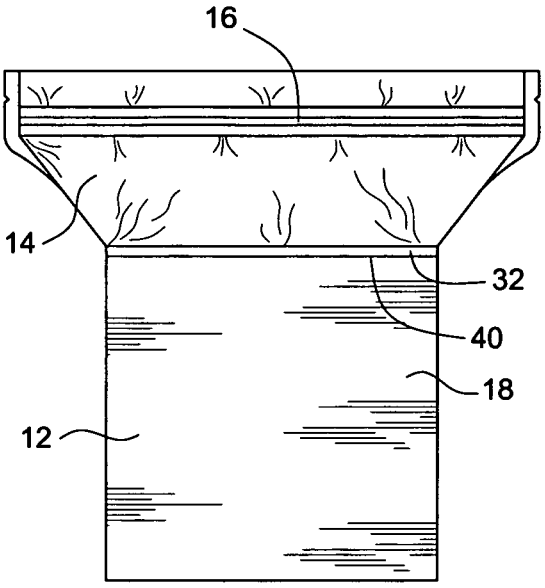
FIG. 4 is a front elevational view of a bag-on-container type assembly where the bag member is attached to the top of a container member.
Figure 5:
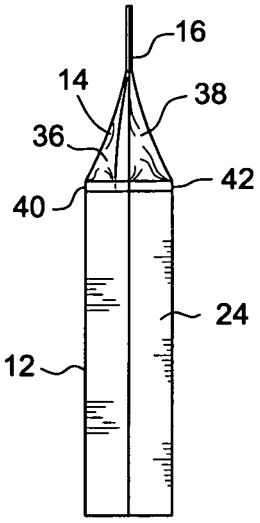
FIG. 5 is a side elevational view of the bag-on-container type assembly shown in FIG. 4.

Lower edges 40 and 42 of bag member 14, as shown in FIG. 3, may be sealed to box blank 52 such as by heat sealing such as during manufacture of bag-on-container type assemblies. Thereafter, box blank may be expanded and bottom flaps 26, 28 and 30 folded and secured together to yield container member 12.

A portion or all of the interior surfaces of container member 12 employed in each of the bag-on-container and bag-in-container type assemblies, such as those portions that form strips 32 and 34, may be coated with materials such as protectant materials, adhesive materials or combinations thereof. Protectant materials that may be employed include but are not limited to thermoplastics such as polyethylene or copolymers thereof. Advantageously, when the interior surfaces of container member 12 are coated with thermoplastics such as polyethylene, exposed surfaces of strips such as strips 32 and 34 that bear thermoplastic are available for bonding to bag member 14.

A portion or the entire exterior of box blank 52 employed to form container member 12 may be coated with a protective material such as a thermoplastic such as polyethylene or copolymers thereof. The protective material may function to further protect the contents in container member 12 and may enable bag member 14 to be heat sealed to container member 12.

When forming a bag-on-container type assembly, bag member 14 may be heat shrunk onto the exterior of container member 12. In this aspect, bag member 14 may be formed from heat shrinkable materials such as polypropylene or copolymers thereof. The heat shrinkable material may be employed in combination with one or more adhesives on the heat shrinkable material as well as alternatively on the exterior of container member 12 as illustrated schematically in FIG. 7.

Figure 7:
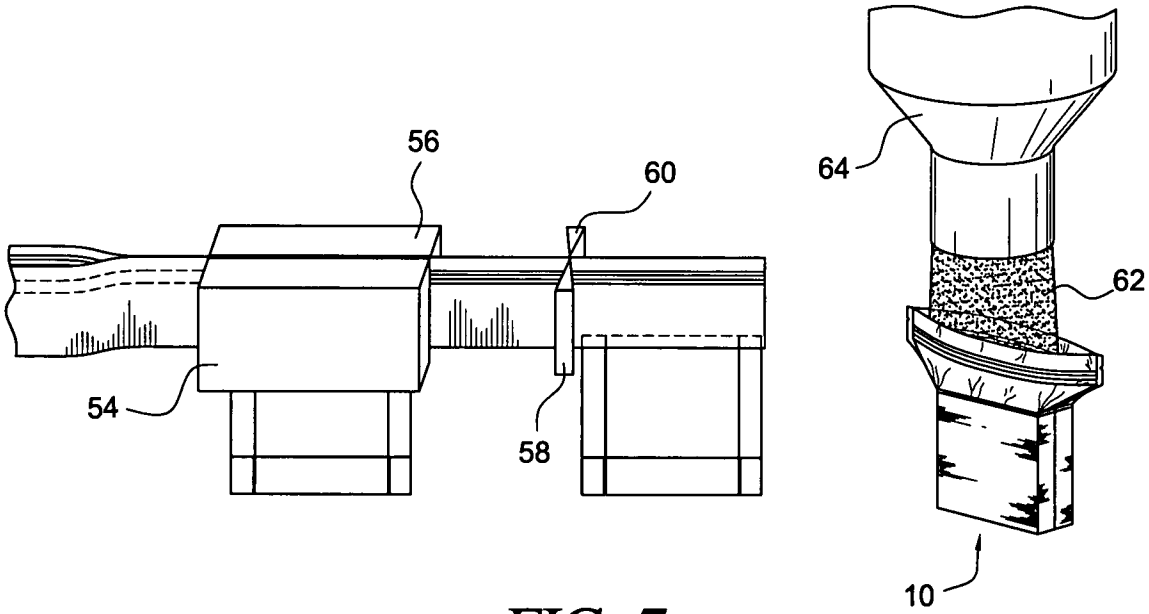
Figure 8:
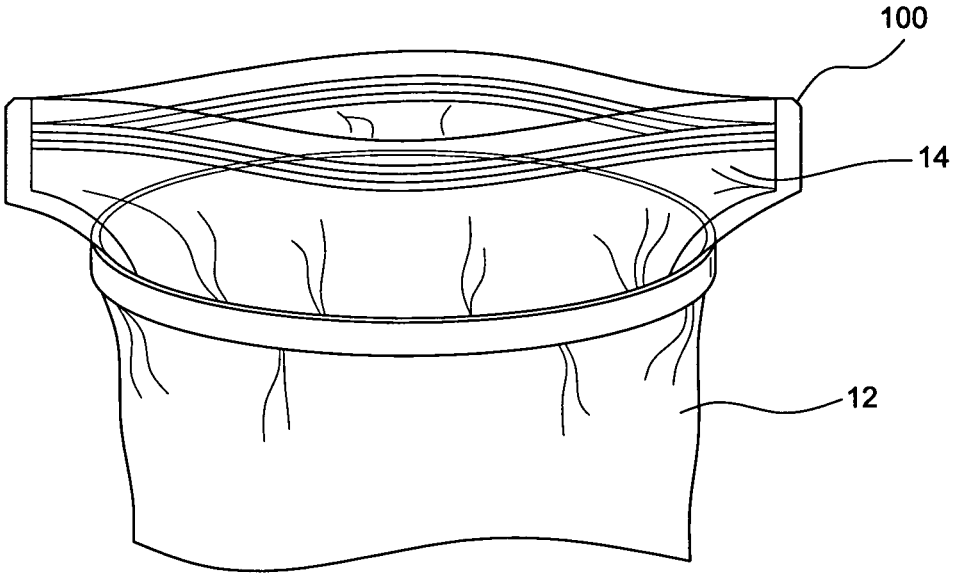
FIGS. 8 and 12 show bag-in-container type assemblies.

During manufacture of a bag-on-container type assembly, as illustrated schematically in FIG. 7, bag member 14 is placed over container member 12 and then bag member 14 and container member 12 are heated to cause bag member 14 to shrink onto the exterior of container member 12.

Bag member 14, where employed in manufacture of a bag-in-container type assembly, may be non-sealable or resealable, preferably resealable. Where bag member 14 is resealable, bag member 14 may employ a resealable closure 16 at a desired location of bag member 14, such as at the top of bag member 14 as well as at one or more corners of bag member 14 as shown in FIG. 9.

Bag member 14 may be adhered to a portion of one or more interior surfaces of container member 12, or to all of the interior surfaces of container member 12, to produce a bag-in-container type container assembly 100. The top of bag member 14, when employed in bag-in-container assembly 100, may extend above the top surface of container member 12. The top of bag member 14 also may be flush with the top of container member 12 or may lie below the top of container member 12. The bottom of bag member 14, when employed in a bag-in-container type assembly 100, may extend up to the bottom of container member 12.

Various portions of container member 12, when employed in a bag-in-container type assembly, may be opened to expose bag member 14 within container member 12 for removal of product from container member 12. Container member 12 may be resealed over bag member 14. Resealing of container member 12 may be achieved by adhesives such as low tack adhesives such as rubber type adhesives, organic copolymer adhesives, acrylic adhesives or mixtures thereof. These adhesives may be distributed on desired portions of container member 12 where resealing of those portions of container member 12 is desired.

Resealable closure 16, where employed in a resealable bag member 14 for use in any of bag-on-container assemblies and bag-in-container assemblies, may be in a wide variety of forms such as zippers, magnetic media, adhesive tape, loop and hook fasteners such as Velcro or combinations thereof. Zippers for use with bag member 14 may be press to close type, slider type or combinations thereof depending on the type of container system and the product intended for storage in container member 12 employed in the container system. Press to close type zipper and slider type zipper closures are available from Zip-Pak Co. and from Pactiv Corp.

Figure 6:
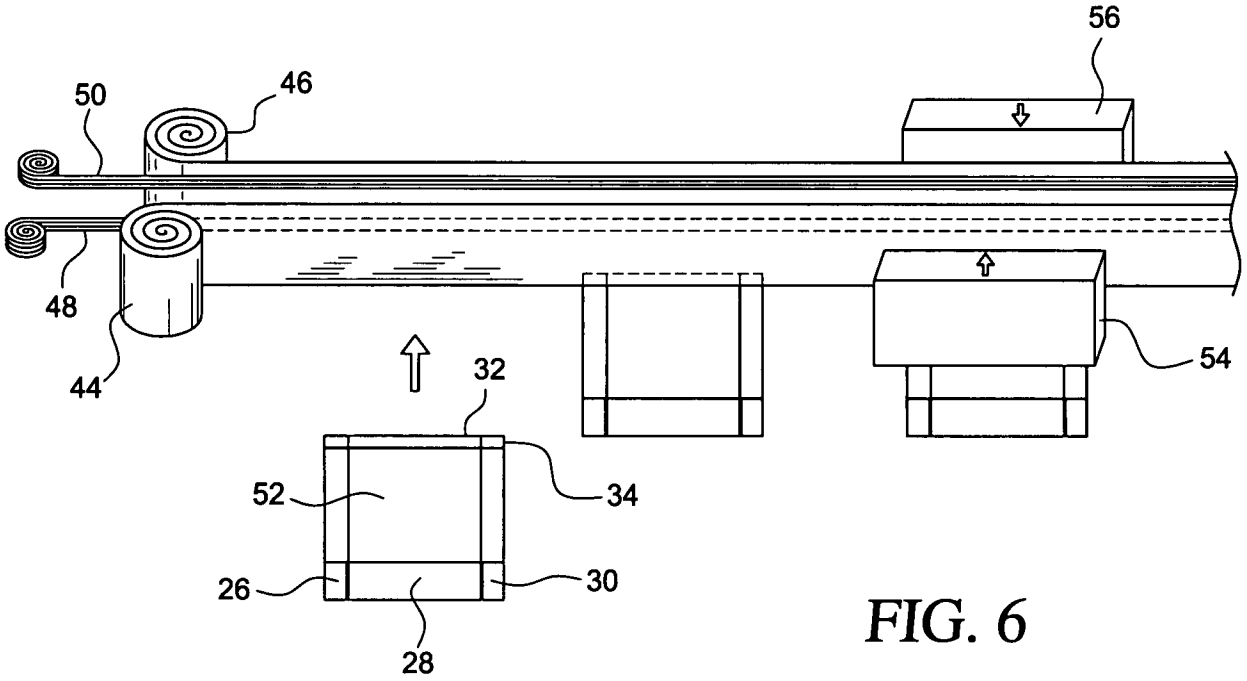
FIGS. 6 and 7 are schematics that show a process for manufacture of a bag-on-container type assembly.

FIGS. 6 and 7 schematically illustrate a process for producing a bag-on-container type assembly 10 that includes container member 12 in the form of a box and bag member 14 disposed on container 12. During manufacture of a bag-on-container type assembly as illustrated in FIG. 6, rolls 44 and 46 of bag forming material are arranged to be used to form front wall 36 and rear wall 38 of bag member 14 on box blank 52. Male and female components 48 and 50 of a closure member 16 such as a zipper are arranged on rolls 44 and 46 of bag forming materials. A box blank 52 with the upper ends folded to form strips 32 and 34 is positioned at the lower edge of rolls 44 and 46 of the bag forming materials.

Figure 10A:
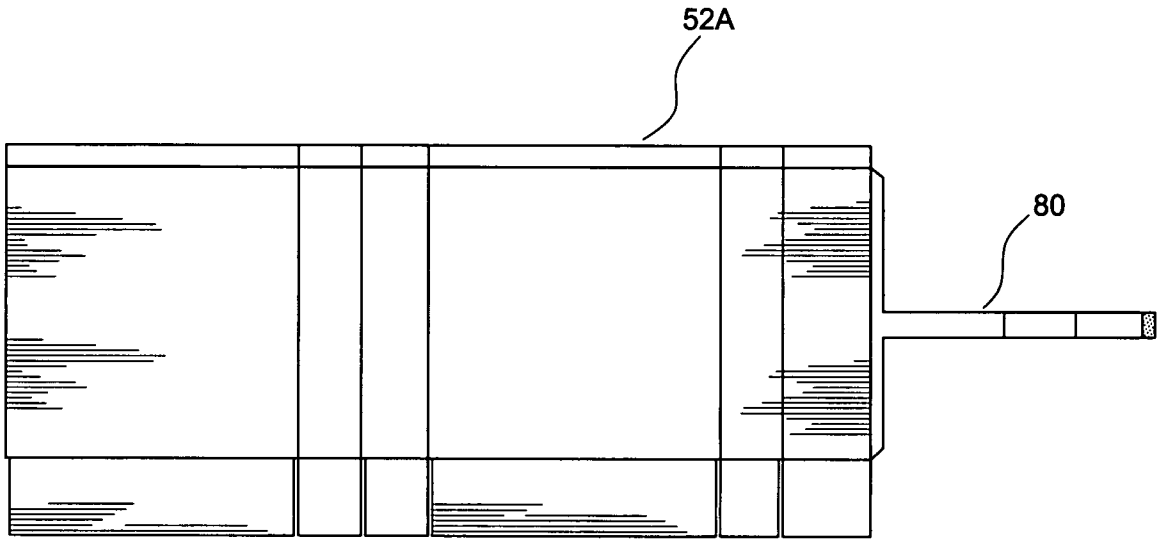
FIG. 10A shows a box blank that includes a reinforcement member for use in manufacture of the container member shown in FIG. 10.

After having positioned rolls 44, 46 of bag forming materials and box blank 52, opposed heat sealing dies 54 and 56 are employed to heat seal components 48 and 50 of closure member 16 to bag forming materials provided by rolls 44 and 46. Heat sealing dies 54, 56 enable heat sealing of bag forming materials provided by rolls 44 and 46 to any of adhesives, thermoplastic coatings or combinations thereof present on strips 32 and 34 of box blank 52. Container member 12 may include a reinforcement member such as reinforcement 80 as shown in FIG. 10. In this aspect, container member 12 may be made with box blank 52A as shown in FIG. 10A. Reinforcement member 80 may be present in box blank 52 at a desired location. Bag member 14 then may be secured to container member 12 to produce a bag-on-container type assembly. Where adhesive bonding is employed to adhere bag member 14 to container member 12 employed in each of the bag-on-container and bag-in-container type assemblies, the adhesive may be applied as an overall coating, or in a pattern where desired. Heat sealing of bag member 14 to container member 12 may be performed at about 200° F. to about 450° F., preferably about 250° F. to about 425° F., more preferably about 300° F. to about 400° F. Heat sealing may be performed for about 0.1 sec to about 2 sec, preferably about 0.3 sec to about 1 sec, more preferably about 0.5 sec to about 0.75 sec. Heat sealing may be performed in one step or a plurality of steps, preferably in one step. Heat sealing may be performed by generation of heat by well-known techniques such as conduction, induction, ultrasonic vibration and combinations thereof. Preferably, heat sealing is performed by conduction such as by use of heated rollers. Where heated rollers are employed, pressure applied during heat sealing may vary from about 5 PSI to about 1000 PSI, preferably about 50 PSI to about 700 PSI, more preferably about 150 PSI to about 500 PSI.

As shown in FIG. 7, cutting means such as laser, mechanical knives or combinations thereof, preferably mechanical knives such as knife blades 58 and 60, may be used to sever the bag forming materials provided by rolls 44 and 46 to form bag member 14. Thereafter, box blank 52 is expanded and filled with product 62 that may be fed through supply means such as hopper 64.

Figure 11:
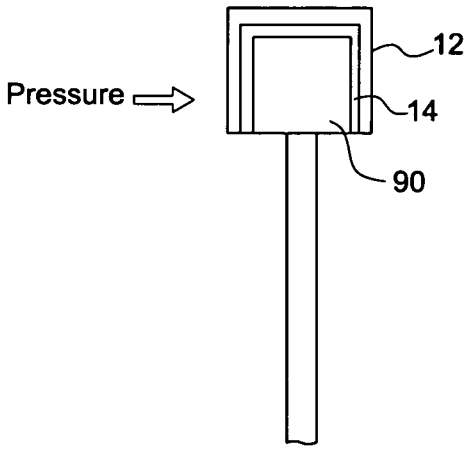
FIG. 11 is a schematic that shows manufacture of a bag-in-container type container assembly.
Figure 12:
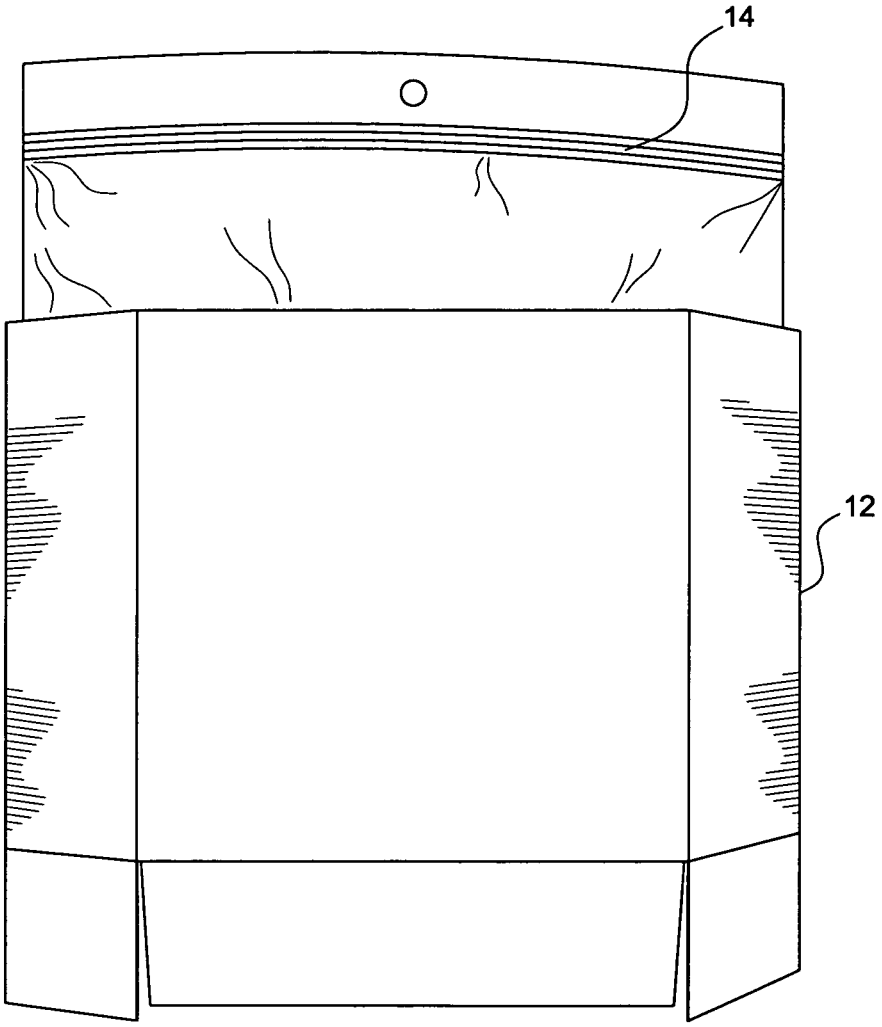

During manufacture of a bag-in-container type container assembly, as shown schematically in FIG. 11, a bag member 14 is placed onto mandrel 90. Bag member 14 preferably includes resealable closure 16. Mandrel 90 is configured to be able to conform to the interior of container member 12. Bag member 14 may, such as on lower edges 40, 42 thereof, include an adhesive. Alternatively, as well as in addition to adhesive present on bag member 14, the interior of container member 12 may be coated with a bondable material such as a thermoplastic, adhesive or combinations thereof.

In manufacture, pressure may be applied to container member 12 while mounted on the mandrel. The amount of pressure may vary depending on the material employed in container member 12, as well as the temperature of the mandrel 90 over bag member 14. The pressure and time of application is sufficient, however, to cause container member 12 to intimately conform to the shape of mandrel 90 and to bond bag member 14 to at least a portion of the interior surfaces of container member 12. Typically, the temperature of mandrel 90 is about 200° F. to about 450° F., preferably about 250° F. to about 425° F., more preferably about 300° F. to about 400° F., the pressure is about 5 PSI to about 1000 PSI, preferably about 50 PSI to about 700 PSI, more preferably about 150 PSI to about 500 PSI and is applied for about 0.1 sec to about 2 sec, preferably about 0.3 sec to about 1 sec, more preferably about 0.5 sec to about 0.75 sec. Mandrel 90 may be heated or cooled, preferably heated. Mandrel 90 also may be employed independent of heating or cooling. Mandrel 90 may be expanded while heating to enable bonding of bag member 14 to at least a portion of the interior surfaces of container member 12 such as where interior surfaces of container member 12 are coated with a thermoplastic. Bag member 14 also may be bonded to interior surfaces of container member 12 by coating bag member 14 with an adhesive and placing container member 12 onto bag member 14 disposed on mandrel 90.

Alternatively, a bag-in-container type assembly may be made by first securing bag member 14 that preferably include a closure means thereon, such as a zipper type closure, to the interior surface of a box blank and then applying glue to the side seams of the box blank to retain bag member 14 within container member 12 at a desired location within container member 14. Opposing sides of the box blank then may be folded and secured to each other. Container member 12 optionally may be devoid of top flaps to enable bag member 14 to extend beyond container member 12. In either embodiment where container member 12 includes top flaps or is devoid of top flaps, bag member 14 may folded back into container member 12. Where container member 12 includes top flaps, those flaps may be closed to conceal bag member 14 within container member.

The bag-on-container type assemblies of the invention are able to achieve very high levels of protection against permeation of gases such as water vapor into product present in bag member 14 within container member 12. To illustrate, a bag-on-container assembly was made by adhering a resealable bag member 14 to the exterior of a container member 12 where container member 12 is in the form of box that has a rectangular cross section and a heat-sealed hermetic bottom.

As an illustration of the protection provided against permeation of gases, a bag-on-container assembly is pressurized with one-PSI air pressure. Air flow is controlled by a precision regulator and an in-line flow meter for delivery to via a needle. An adhesive backed foam is used to minimize possible leakage around the needle. The bag on the bag-on-container assembly inflated under the supplied air pressure to register a one-PSI internal pressure. The flow meter, delineated in 0-30 liters/hour, fell to about zero, confirming that an airtight seal is achieved. This decrease in flow rate shows a level of protection not achievable by known packaging.

We claim:

1. A method of forming a bag-on-container assembly comprising the steps of:

providing a box blank suitable for forming a container member having a front wall, a rear wall, a pair of opposed side walls and a plurality of flaps capable of forming a bottom wall and wherein said front, rear and side walls have upper ends and lower ends and inside surfaces and outside surfaces;

providing a bag member having an open end and a closed end wherein the bag member has downwardly extending front and rear walls;

sealing a lower edge of the front and rear walls of the bag member to an exterior portion of the box blank while said blank is in a flat planar condition, and thereafter, expanding said front, rear and side walls of said box blank to form a bag-on-container assembly.

2. The method of claim 1 wherein the bag member includes a resealable closure means to enable resealing of the closed end of the bag member.

3. The method of claim 2 wherein the closure means is a zipper.

4. The method of claim 3 wherein the zipper is located at a corner of the bag member.

5. The method of claim 1 further comprising the step of folding outwardly and downwardly the upper end of each of said front, rear and side walls of said box blank whereby an inside surface of each of the upper ends forms a strip that faces outwardly.

6. The method of claim 5 further including the step of securing said strips in their folded position.

7. The method of claim 6 wherein the lower edge of said bag front and rear walls are sealed to the strips.

8. The method of claim 1 wherein the inside surfaces of the box walls include outwardly facing strips having a thermal plastic coating thereon.

9. The method of claim 8 wherein the lower edge of the bag front and rear walls are heat sealed to the strips.

* * * * *